US007247081B2

(12) United States Patent
Kamiya et al.

(10) Patent No.: US 7,247,081 B2
(45) Date of Patent: Jul. 24, 2007

(54) PRECISION MACHINING APPARATUS AND PRECISION MACHINING METHOD

(75) Inventors: Sumio Kamiya, Toyota (JP); Hisao Iwase, Aichi (JP); Tetsuya Nagaike, Toyota (JP); Hiroshi Eda, Ibaraki (JP); Libo Zhou, Hitachi (JP)

(73) Assignee: Toyoda Jidosha Kabushiki Kaisha, Aichi (JP)

( * ) Notice: Subject to any disclaimer, the term of this patent is extended or adjusted under 35 U.S.C. 154(b) by 0 days.

(21) Appl. No.: 11/316,886

(22) Filed: Dec. 27, 2005

(65) Prior Publication Data

US 2006/0194510 A1 Aug. 31, 2006

(30) Foreign Application Priority Data

Dec. 28, 2004 (JP) ..... 2004-380782

(51) Int. Cl.
*B24B 49/00* (2006.01)

(52) U.S. Cl. ..... 451/10; 451/11; 451/246

(58) Field of Classification Search ..... 451/5, 451/10, 11, 14, 242, 246
See application file for complete search history.

(56) References Cited

U.S. PATENT DOCUMENTS 3,728,826 A * 4/1973 Wada et al. ..... 451/5
3,748,789 A 7/1973 Wada et al.
4,294,045 A * 10/1981 Enomoto et al. ..... 451/5
4,368,596 A * 1/1983 Wada et al. ..... 451/5
4,670,964 A * 6/1987 Bleich ..... 483/33
5,006,685 A * 4/1991 Hatano et al. ..... 219/69.2
6,447,379 B1 9/2002 Gromko et al.

FOREIGN PATENT DOCUMENTS

JP 2000-141207 5/2000
JP 2001-265441 9/2001
JP 2001-328065 11/2001
JP 2002-127003 5/2002
JP 2003165042 6/2003

* cited by examiner

*Primary Examiner*—Eileen P. Morgan
(74) *Attorney, Agent, or Firm*—Finnegan, Henderson, Farabow, Garrett & Dunner, LLP

(57) ABSTRACT

A precision machining apparatus and a precision machining method capable of carrying out grinding with accuracy by performing switching control, for example, on a device for rotating a grinding wheel according to grinding stages through the amount of movement and constant pressure changed stepwise. To a second pedestal 3 supporting a rotary device 6*b* for rotating a grinding wheel b, an actuator 5 and a feed screw mechanism 4 constituted by at least a feed screw 41 and a nut 42 are attached. In a rough grinding stage, the movement of the rotary device 6*b* and the second pedestal 3 is adjusted through a predetermined amount of movement of the nut 42. In a super-precision grinding stage, the movement of the rotary device 6*b* and the second pedestal 3 is adjusted by pressure control using stepwise a plurality of pneumatic actuators 5*a*, 5*b* differing in pressure performance. An attitude control device 7 is interposed between a first pedestal 2 and a rotary device 6*a* for rotating an object a to be ground.

9 Claims, 5 Drawing Sheets

PRECISION MACHINING APPARATUS AND PRECISION MACHINING METHOD

BACKGROUND OF THE INVENTION

1. Field of the Invention

The present invention relates to a precision machining apparatus and a precision machining method used for working an object which needs to be worked so that the shape/size accuracy and the flatness of a finished surface is high, e.g., a silicon wafer or a magnetic disk substrate. More particularly, the present invention relates to a precision machining apparatus and a precision machining method capable of carrying out grinding with accuracy by performing switching control, for example, on a device for rotating a grinding wheel according to grinding stages through the amount of movement and constant pressure changed stepwise.

2. Background Art

There has recently been an increasing demand for reducing energy loss in next-generation power devices while reducing the size of the devices. An example of such a demand includes a demand for increasing the number of layers in a semiconductor multilayer structure for electronics purposes and increasing the packaging density of semiconductor devices. Examples of methods conceivable as measures to meet such a demand include a method for reducing the thickness of semiconductor wafers typified by a Si wafer to an extremely small value, a working method which prevents dislocation and lattice strain in a worked surface and a portion below a worked surface, and a working method which reduces the surface roughness (Ra) to a value in a range from the subnanometer (nm) level to the nanometer (nm) level and reduces the flatness of a worked surface to a value in a range from the submicrometer (μm) level to the micrometer (μm) level or a lower range.

In the motor vehicle industry, an integrated bipolar transistor (IGBT) which is a power device for motor vehicles forms an essential system in inverter systems. A further improvement in marketability of hybrid vehicles achieved by improving the performance of an inverter using the IGBT and by reducing the size of the inverter is being expected. Reducing the thickness of the Si wafer constituting the IGBT to 50 to an extremely small value of about 150 μm, preferably 80 to 140 μm, more preferably 90 to 120 μm to reduce switching loss, steady loss and thermal loss is indispensable to improving the inverter. Further, an improvement in yield in a process step of forming electrodes on the semiconductor and an increase in the number of layers in the semiconductor multilayer structure can be achieved by forming a perfect surface with no dislocation and no lattice strain in a worked surface of a circular Si wafer having a diameter of 200 to 400 mm or in an internal portion in the vicinity of the worked surface and by reducing the surface roughness (Ra) to a value in a range from the subnanometer level to the nanometer level and the flatness to a value in a range from the submicrometer level to the micrometer level.

In ordinary cases under present circumstances, a multistep process including rough grinding using a diamond grinding wheel, lapping, etching and wet chemo-mechanical polishing (wet-CMP) using a loose abrasive is required for the above-described semiconductor working process. It is extremely difficult to obtain a perfect surface by the conventional working method using such process steps, since an oxide layer, dislocation and lattice strain are produced in the worked surface. Also, the flatness of a wafer worked by the conventional method is low and a break in the wafer may be caused during working or after electrode formation, which leads to a reduction in yield. Further, in the conventional working method, the difficulty in reducing the wafer thickness to an extremely small value is increased with the increase in wafer diameter to 200 mm, to 300 mm and to 400 mm. Studies are presently being conducted to reduce the thickness of a wafer having a diameter of 200 mm to the 100 μm level.

In view of the above-described problem of the conventional art, the inventors of the present invention disclosed an invention relating to a precision surface working machine capable of consistently performing a process from rough working to super-precision surface working including final ductility mode working with efficiency by using only a diamond grinding wheel (JP Patent Publication (Kokai) No. 2000-141207 A).

In this grinding using a diamond grinding wheel, three essential actions: rotation of the grinding wheel, feed by a main spindle supporting the grinding wheel and positioning of an object to be worked are important. These actions are controlled with accuracy to enable precision working. A process from rough working to super-precision working consistently performed by using one apparatus through the entire process, in particular, requires accurate control of feed by the main spindle through a wide range in the above-described essential actions. For example, a system using a servo motor is ordinarily used for control of the main spindle in conventional grinding. However, this system cannot be said to be adequate for accurate control through low-pressure and high-pressure regions. This system is inadequate for working in a low-pressure region in which super-precision working is performed, in particular.

The inventors of the present invention then disclosed a precision working machine in which pressure control is performed by means of a combination of a servo motor and a super-magnetostrictive actuator. Control is performed by means of the servo motor and a piezoelectric actuator in a pressure range of 10 gf/cm$^2$ or higher and is performed by means of the super-magnetostrictive actuator in a pressure range from 0.01 to 10 gf/cm$^2$. In this way, a process from rough working to super-precision working can be consistently performed by using one apparatus through the entire process. In this precision working machine, a diamond cup type of grinding wheel having an abrasive grain size finer than No. 3000.

In the precision working machine disclosed in JP Patent Publication (Kokai) No. 2000-141207 A, a process from rough grinding to super-precision working can be consistently performed by using one apparatus through the entire process, and extremely high accuracy with which a surface to be finished is worked can be achieved. However, there has been a problem that when super-precision working is performed by means of the super-magnetostrictive actuator only, heat generated from the super-magnetostrictive affects other components of the precision working machine and the other components and they may be damaged by the heat.

SUMMARY OF THE INVENTION

In view of the above-described problems, an object of the present invention is to provide a precision machining apparatus and a precision machining method in which control based on the amount of movement of a grinding wheel or an object to be ground and control based on pressure (constant pressure) are combined to realize efficient and highly accurate grinding.

Another object of the present invention is to provide a precision machining apparatus and a precision machining method in which multi-stage pressure control is performed with respect to working stages without using a super-magnetostrictive actuator for pressure control, and which are, therefore, capable of improving the working accuracy while eliminating the need to consider a heat generation problem at each working stage.

To achieve the above-described objects, according to the present invention, there is provided a precision machining apparatus including a rotary device for rotating an object to be ground, a first pedestal supporting the rotary device, a rotary device for rotating a rotary device, a second pedestal supporting the rotary device for rotating the grinding wheel, and movement adjustment means provided at the first pedestal and/or the second pedestal, the movement adjustment means being capable of moving one of the pedestals toward the other, wherein the movement adjustment means includes a first movement adjusting portion which physically moves the pedestal and a second movement adjusting portion which applies a pressure to the pedestal to cause the pedestal to slide in the direction of the movement, and wherein the amount of movement of the pedestal and the rotary device can be controlled by selectively using the first movement adjusting portion and the second movement adjusting portion.

The present invention relates to a precision machining apparatus capable of consistently performing a process from rough grinding to super-precision grinding on an object to be ground by using one precision machining apparatus through the process. The rotary device for rotating the object to be ground while holding the object and the rotary device for rotating a grinding wheel are mounted on the pedestals, with the work surface of the object to ground and the grinding wheel surface facing each other. The object to be ground and the grinding wheel are positioned so that the axes thereof are aligned with each other. For example, the first pedestal supporting the rotary device for rotating the object to be ground is fixed and grinding is carried out while the amount of movement of the second pedestal supporting the rotary device for rotating the grinding wheel is being controlled according to working stages by means of the first movement adjusting portion and the second movement adjusting portion.

The first movement adjusting portion is a mechanism for control based on the amount of movement of the pedestal physically moved. The second movement adjusting portion is a constant-pressure control mechanism which applies a constant pressure to the pedestal to move the pedestal. To carry out super-precision grinding with efficiency, control of the pedestal based on the amount of movement is preferably performed from the viewpoint of the amount of grinding, grinding efficiency and other factors in at an initial rough grinding stage, and finishing by constant-pressure control changing the pressure stepwise is preferably performed at a final finishing stage (super-precision grinding stage). The present invention therefore provides the precision machining apparatus having the first movement adjusting portion and the second movement adjusting portion to carry out consistent grinding by using one apparatus as described above.

In another mode of implementation of the precision machining apparatus of the present invention, the first movement adjusting portion includes a feed screw mechanism in which a nut screw-threaded on a feed screw is moved by the rotation of the feed screw, and the second movement adjusting portion includes a pneumatic actuator or a hydraulic actuator.

For example, in a mode of implementation in which the second pedestal supporting the rotary device for rotating the grinding wheel is moved toward the object to be ground, a feed screw and a nut constituting a so-called feed screw mechanism (first movement adjusting portion) are mounted to the second pedestal, and a suitable pneumatic actuator or a hydraulic actuator (second movement adjusting portion) is mounted to the second pedestal. The nut of this feed screw mechanism is movably screw-threaded on a feed screw attached to an output shaft of a servo motor and is mounted to the second pedestal to enable the second pedestal to be controllably moved. This screw feed mechanism and the actuator can be selected as required according to grinding stages. For example, the feed screw mechanism is selected at the initial rough grinding stage before a certain degree of surface roughness in the surface of the object to be ground is obtained. Rough grinding on the surface of the object to be ground is carried out by moving the rotary device (grinding wheel) on the second pedestal to the object to be ground according to the suitable amount of movement of the nut. When rough grinding on the surface of the object to be ground is completed, the control mode is changed from control based on the amount of movement to constant-pressure control in the super-precision grinding stage. At the time of this control mode change, the grinding wheel to be used is replaced with a grinding wheel for super-precision grinding. In the super-precision grinding stage, the surface of the object to be ground is finished by extremely small amount of grinding. In this grinding, there is a need to press the grinding wheel against the surface of the object to be ground at a constant pressure. According to the present invention, a pneumatic actuator or a hydraulic actuator is used to achieve this constant-pressure control.

The precision machining apparatus of the present invention can selectively use the feed screw mechanism and the pneumatic or the hydraulic actuator and can, therefore, perform the process from rough grinding to super-precision grinding consistently by using one precision machining apparatus through the entire process. Since a well-known pneumatic or hydraulic actuator is used in the super-precision grinding stage in which constant-pressure control is required, there is no heat generation problem and the like at the time of operation of the actuator and the apparatus can be manufactured at a reduced cost.

In still another mode of implementation of the precision machining apparatus of the present invention, the second movement adjusting portion includes a plurality of pneumatic actuators or hydraulic actuators differing in pressure performance from each other, and the movement of the pedestal and the rotary device by the second movement adjusting portion can be controlled by pressure selectively changed.

In the super-precision grinding stage, there is a need to carry out multi-stage constant-pressure grinding by performing adjustment for enabling working on the object to be ground to enter a ductility mode and by gradually reducing the pressure.

In the present invention, the above-described multi-stage constant-pressure grinding is carried out by means of actuators having pressure performances according to constant-pressure grinding stages. For example, in a case where pressure control at 10 mgf/cm$^2$ to 5000 gf/cm$^2$ is required, the grinding process is divided into grinding in two stages: grinding in a low-pressure region from 10 mgf/cm$^2$ to 300 gf/cm$^2$, and a grinding in a high-pressure region from 300 gf/cm$^2$ to 5000 gf/cm$^2$, and two actuators to be respectively used in this pressure regions are provided so as to be selectable.

In a further mode of implementation of the precision machining apparatus of the present invention, an attitude control device for controlling the attitude of the rotary device is interposed between the rotary device and the first pedestal or between the rotary device and the second pedestal; the attitude control device includes a first flat-plate member extending in a plane defined by an X-axis and a Y-axis and a second flat-plate member disposed in parallel with the first flat-plate member while being spaced apart from the same; recesses are formed in surfaces of the two flat-plate members facing each other; a spherical member is interposed between the first flat-plate member and the second flat-plate member by fitting portions of the spherical member in the recesses; a first actuator expandable in a Z-axis direction perpendicular to the plane defined by the X-axis and the Y-axis is interposed between the first flat-plate member and the second flat-plate member; a second actuator expandable in a suitable direction in the plane defined by the X-axis and the Y-axis is connected to the second flat-plate member; the second flat-plate member is movable relative to the first flat-plate member while being in an attitude with an object mounted thereon; the spherical member is bonded to the first flat-plate member and/or the second flat-plate member by an adhesive elastically deformable; and a piezoelectric element and a super-magnetostrictive element are provided in each of the first actuator and the second actuator.

Each of the first flat-plate member and the second flat-plate member is formed of a material having a strength high enough to support the weight of an object mounted on the second flat-plate member. Preferably, this material is non-magnetic. This material is not limited to a particular one. However, austenitic stainless steel (SUS) may be used. The spherical member interposed between the first flat-plate member and the second flat-plate member is also formed of a material having a strength high enough to support at least the weight of the object mounted on the second flat-plate member. Therefore, the material forming the spherical member according to the set weight of the mounted object may also be selected from various materials. Example of the material of the spherical member includes a metal. Recesses are formed as portions of the first flat-plate member and the second flat-plate member to be brought into contact with the spherical member. The spherical member is interposed between the flat-plate members, with portions of the spherical member fitted in the recesses. The size of the recesses (depth, opening diameter and the like) is suitably adjusted according to the sizes of the flat-plate members and the spherical member and the required attitude control accuracy for example. However, it is required that a predetermined spacing is maintained a least between the first flat-plate member and the second flat-plate member in the stage where the portions of the spherical member are fitted in the recesses of the two flat-plate members. This spacing is set to such a value that the second flat-plate member does not contact the first flat-plate member even when it is inclined by the operation of the second actuator.

The surfaces of the recessed portions of the two flat-plate members facing each other and the spherical member may be bonded by an adhesive. As this adhesive, a suitable adhesive having such a property as to be elastic at ordinary temperature may be used. For example, an elastic epoxy adhesive or any other elastic adhesive may be used. For example, an adhesive having a tensile shear strength of 10 to 15 Mpa, an attenuation coefficient of 2 to 7 Mpa·sec, preferably 4.5 Mpa·sec and a spring constant of 80 to 130 GN/m, preferably 100 GN/m may be used. The thickness of the adhesive film may be set to about 0.2 mm. A mode of implementation in which a recess is formed in only one of the first flat-plate member and the second flat-plate member, a portion of the spherical member is fitted in the recess, and the recessed surface and the spherical member are bonded by an adhesive is conceivable as well as that in which recesses are formed in the two flat-plate members.

A mode of implementation of the attitude control device is conceivable in which the spherical member and two first actuators are interposed between the first flat-plate member and the second flat-plate member at positions corresponding to vertices of a triangle freely selected in a plane, as seen in plan. A mode of implementation is conceivable in which the second actuator is attached to the second flat-plate member at least at one of four edges of the second flat-plate member. If at least these three actuators are used, the second flat-plate member can be three-dimensionally displaced relative to the first flat-plate member while being in an attitude with the object directly mounted thereon. When the second flat-plate member is displaced, the adhesive on the surface of the spherical member supporting the second flat-plate member from below is elastically deformed to achieve free displacement of the second flat-plate member substantially free from restraint.

Preferably, each of the first and second actuators has at least a super-magnetostrictive element. The super-magnetostrictive element is an alloy of a rare-earth metal such as dysprosium or terbium and iron or nickel. The super-magnetostrictive element in the form of a rod can expand by about 1 to 2 μm under a magnetic field produced by applying a current to a coil around the super-magnetostrictive element. This super-magnetostrictive element has such a characteristic as to be usable in a frequency region of 2 kHz or lower and has a picosecond ($10^{-12}$ sec) response speed and output performance of about 15 to 25 kJ/cm$^3$, e.g., about 20 to 50 times higher than that of the piezoelectric element described below. On the other hand, the piezoelectric element is formed of lead zirconate titanate ($Pb(Zr,Ti)O_3$), barium titanate ($BaTiO_3$), lead titanate ($PbTiO_3$) or the like. The piezoelectric element has such a characteristic as to be usable in a frequency region of 10 kHz or higher and as a nanosecond ($10^{-9}$) response speed. The output power of the piezoelectric element is lower than that of the super-magnetostrictive element and is suitable for high-precision positioning control (attitude control) in a comparatively light load region. The piezoelectric element referred to herein also comprises an electrostrictive element.

A mode of implementation is conceivable in which a film is formed by the above-described adhesive on the surface of the spherical member, and the spherical member and the film of the adhesive are separated to be movable relative to each other. The adhesive is made of an elastically deformable material described above. For example, a film formed of this adhesive may be formed on the surface of a metallic spherical member. To reduce the degree of restraint against the second flat-plate member, the spherical member and the adhesive on the outer peripheral surface of the spherical member are separated from each other in the present invention. For example, a graphite film is formed on the surface of the spherical member and a film formed by the adhesive is formed on the outer peripheral surface of the graphite film. The adhesive and the graphite film do not adhere to each other. The adhesive and the graphite film are made substantially separate from each other. Therefore, when the second flat-plate member is displaced, the spherical member can rotate in an unrestrained condition in the fixed position, while the adhesive in the surface layer deforms elastically in response to the deformation of the second flat-plate member without being restrained by the spherical member. In the present invention, a suitable flat-plate member, an adhesive and a spherical member (film on the surface of the spherical member) for realizing the first flat-plate member, the adhesive bonded to the first flat-plate member and the spherical member (or the film on the surface of the spherical member) not bonded to the adhesive are provided. The degree of restraint on the movement of the second flat-plate member is reduced to realize extremely fine real-time movement required of the attitude control device. Further, since the degree of restraint on the second flat-plate member is close to the unrestrained state, the energy required of the second actuator at the time of displacement of the second flat-plate member can be reduced in comparison with the conventional art.

According to the present invention, the super-magnetostrictive element and the piezoelectric element in each actuator can be selectively used as required depending on the weight of a load or a grinding step. Therefore, grinding can be performed while effectively reducing the influence of heat generated in the case of using only the super-magnetostrictive element and controlling the attitude of the rotary device with high accuracy. Grinding is performed while a misalignment between the axes of the rotary devices facing each other is being suitably corrected by the attitude control device. Since each of the super-magnetostrictive element and the piezoelectric element has a high response speed, the super-magnetostrictive element and the piezoelectric element are selectively used in the present invention in such a manner that while the piezoelectric element is used in principle, the super-magnetostrictive element is used when required. Further, a small misalignment between the axes is detected at all times. The detected small misalignment is processed by numeric processing in a computer to be input as a necessary amount of expansion to each of the super-magnetostrictive element (super-magnetostrictive actuator) and the piezoelectric element (piezoelectric actuator).

In a further mode of implementation of the precision machining apparatus of the present invention, the grinding wheel comprises at least a CMG grinding wheel.

The CMG grinding wheel (bonded abrasive) is a grinding wheel used when final grinding is performed as chemo mechanical grinding (CMG). This method is used for performing only a grinding process using a CMG grinding wheel instead of the multistep process including etching, lapping and polishing in the conventional art. The development of the CMG method is presently being pursued. In grinding, the diamond grinding wheel is used in the rough grinding stage, while the CMG grinding wheel is used in the super-precision grinding stage, thus selectively using the grinding wheels.

According to the present invention, there is also provided a precision machining method using a precision machining apparatus including a rotary device for rotating an object to be ground, a first pedestal supporting the rotary device, a rotary device for rotating a rotary device, a second pedestal supporting the rotary device for rotating the grinding wheel, and movement adjustment means provided at the first pedestal and/or the second pedestal, the movement adjustment means being capable of moving one of the pedestals toward the other, the movement adjustment means including a first movement adjusting portion which physically moves the pedestal and a second movement adjusting portion which applies a pressure to the pedestal to cause the pedestal to slide in the direction of the movement, the amount of movement of the pedestal and the rotary device being controllable by selectively using the first movement adjusting portion and the second movement adjusting portion, the precision machining method including a first step of forming an intermediate ground object by performing rough grinding on the object to be ground, and a second step of forming a final ground object by grinding the intermediate ground object using a CMG grinding wheel, wherein the movement of the rotary device and the pedestal is adjusted by the first movement adjusting portion in the first step, and the movement of the rotary device and the pedestal is adjusted by the second movement adjusting portion in the second step.

For example, rough grinding using the diamond grinding wheel is performed in the first step, and super-precision grinding using the CMG grinding wheel is performed in the second step.

The first movement adjusting portion for carrying out the first step is, for example, a control mechanism for physically moving the second pedestal by a certain amount toward the first pedestal by using a feed screw mechanism and the like, as described above.

The second movement adjusting portion for carrying out the second step is a mechanism for carrying out constant-pressure control in stages, as described above. This mechanism may be implemented so that a suitable pneumatic or hydraulic actuator is elected with respect to each pressure stage.

As can be understood from the above, the precision machining apparatus and the precision machining method of the present invention make it possible to consistently perform a process from rough grinding to super-precision grinding by selectively performing control using the first movement adjusting portion, e.g., a feed screw mechanism and based on the amount of movement and multistep constant-pressure control using the second movement adjusting portion, e.g., a pneumatic actuator or a hydraulic actuator, thus achieving efficient and accurate grinding. In the precision machining apparatus of the present invention, the attitude control device constructed by interposing a spherical member between two flat-plate members corrects the attitude of the rotary device during grinding if necessary, thereby further improving the grinding accuracy. Further, since the precision machining apparatus of the present invention is arranged so that a super-magnetostrictive actuator is not used for pressure control in the super-precision grinding stage, there is no need to consider a heat generation problem in each grinding stage.

DETAILED DESCRIPTION OF THE PREFERRED EMBODIMENTS

Figure 1:
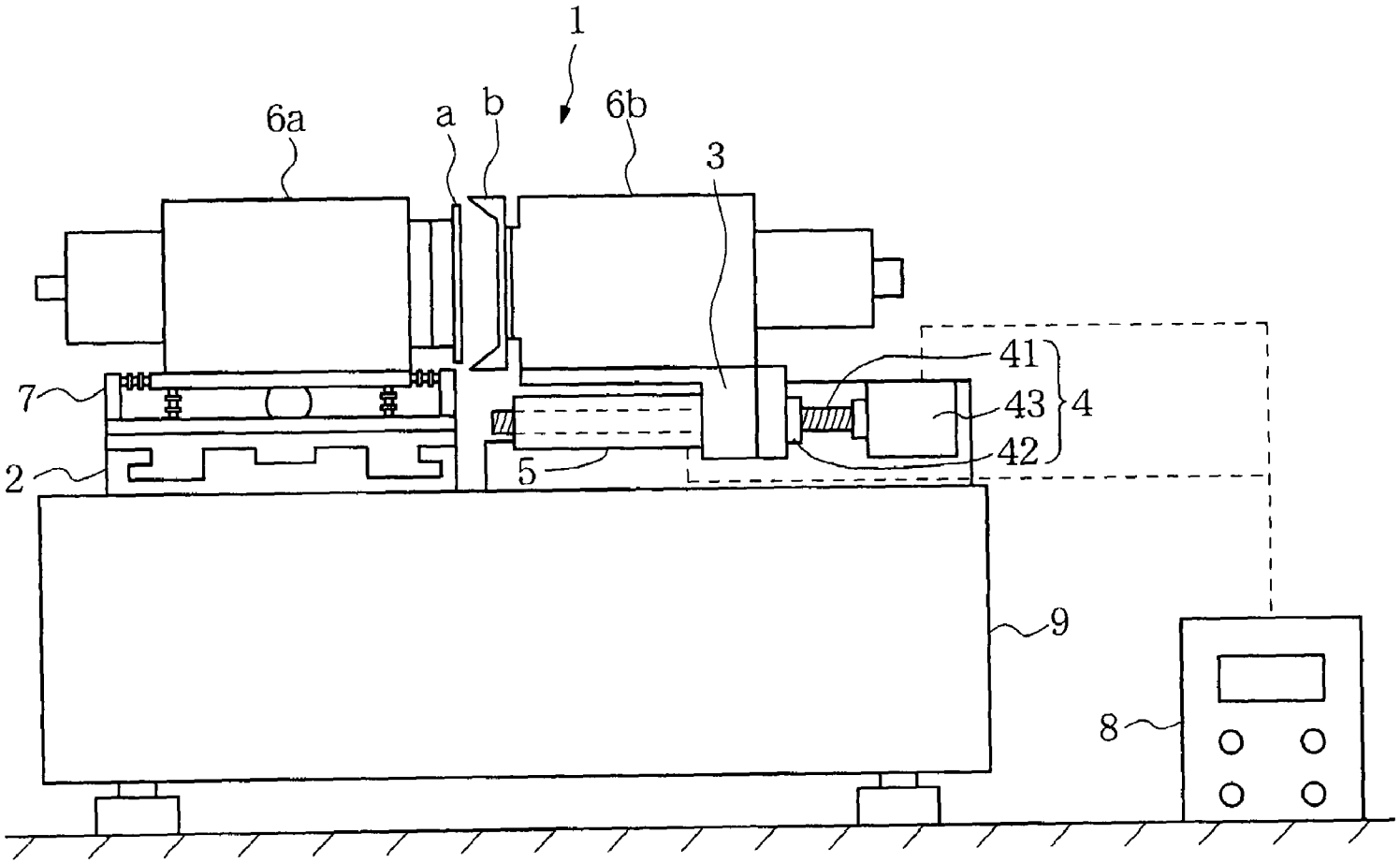
FIG. 1 is a side view of an embodiment of a precision machining apparatus of the present invention.
Figure 2:
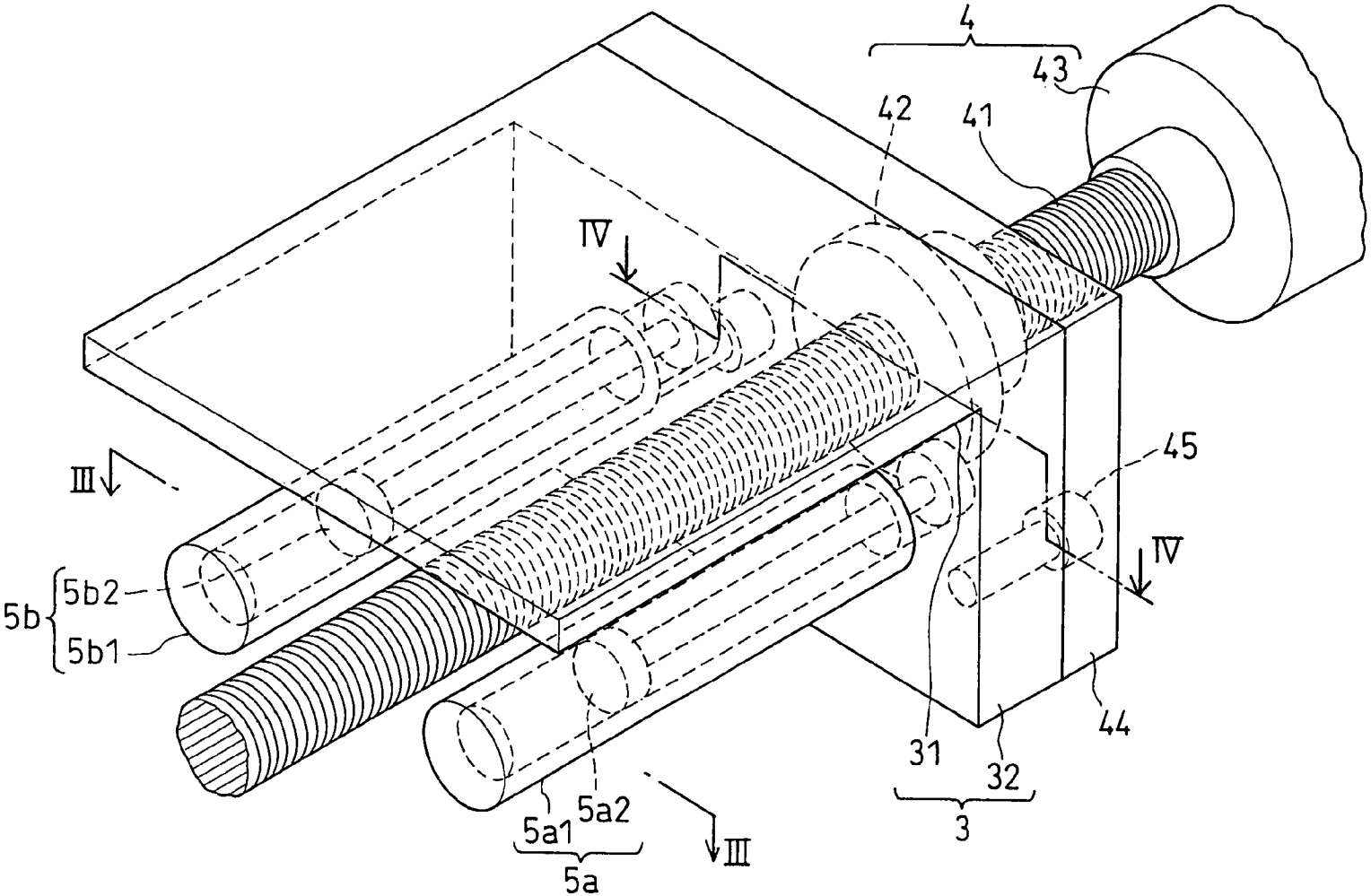
FIG. 2 is a perspective view of movement adjustment means.
Figure 3:
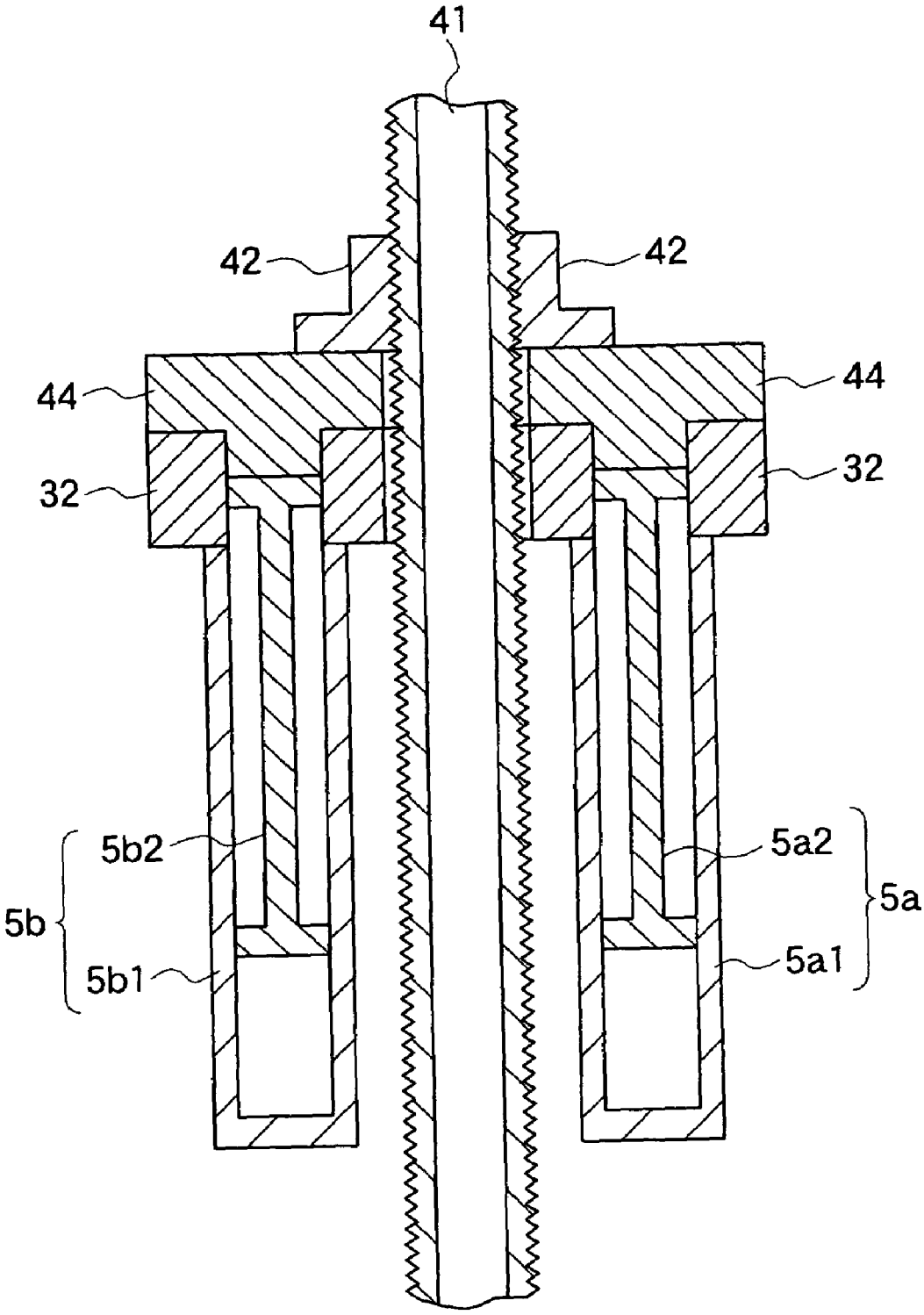
FIG. 3 is a sectional view taken along line III-III in FIG. 2.
Figure 4:
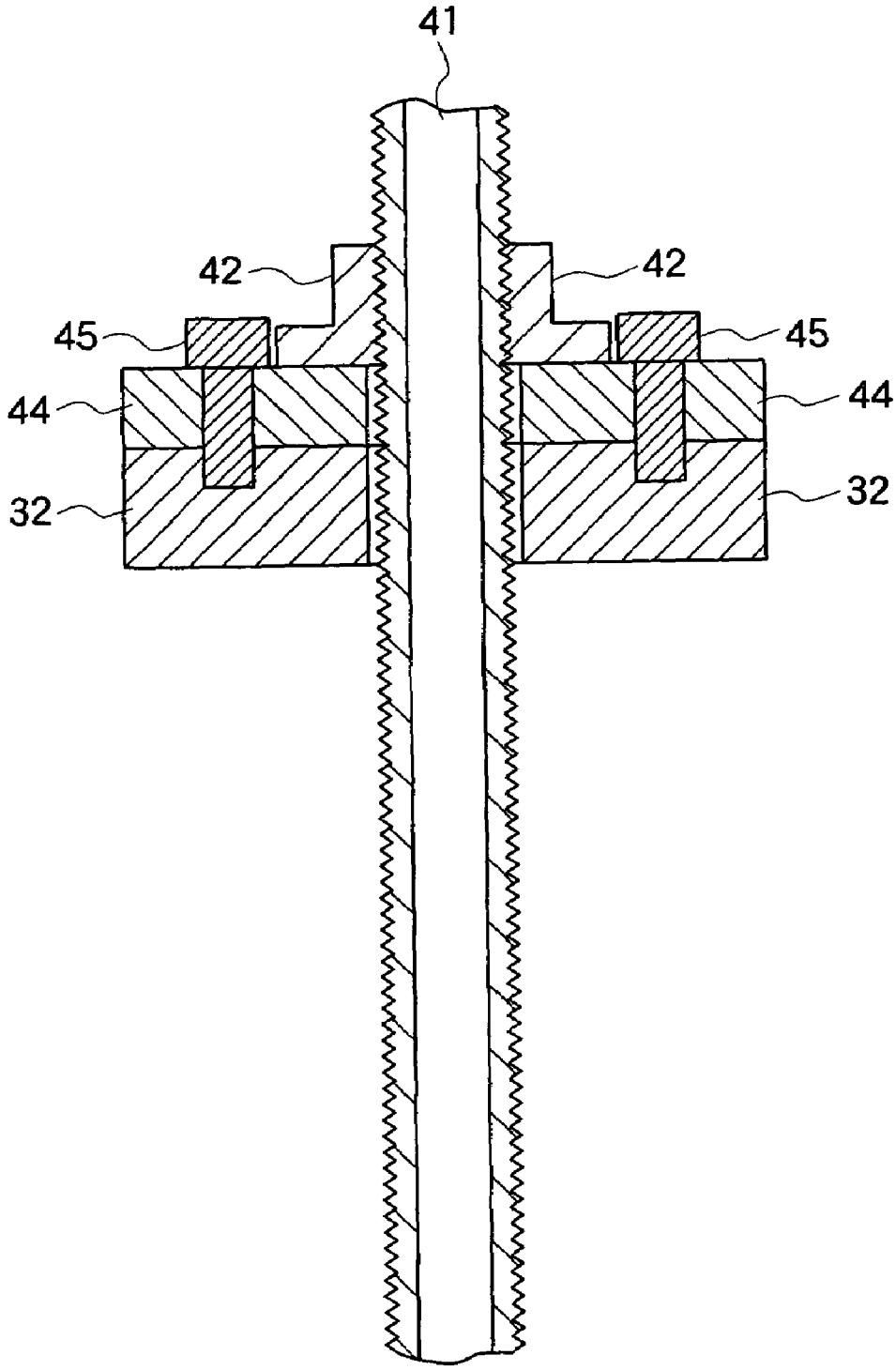
FIG. 4 is a sectional view taken along line IV-IV in FIG. 2.
Figure 5:
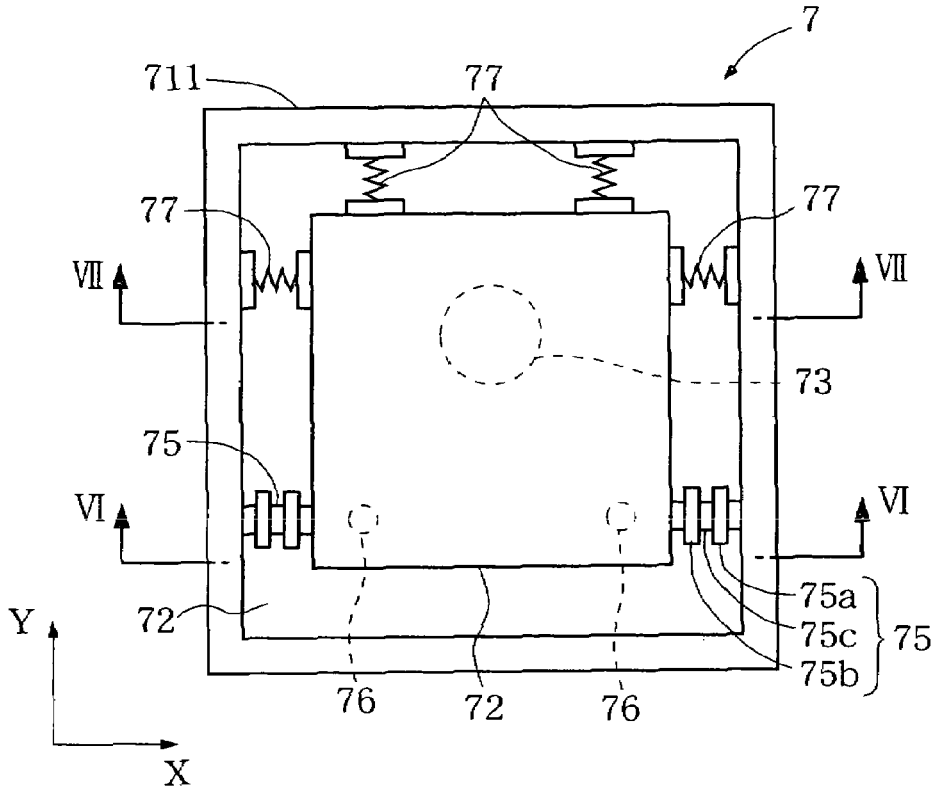
FIG. 5 is a plan view of an embodiment of an attitude control device.
Figure 6:
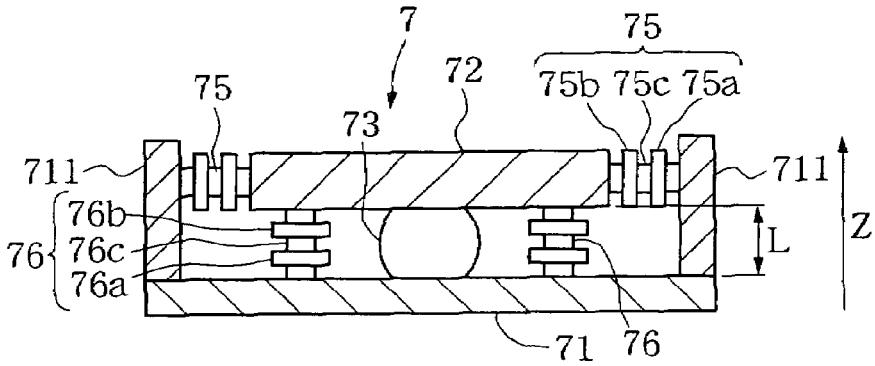
FIG. 6 is a sectional view taken along line VI-VI in FIG. 5.
Figure 7:
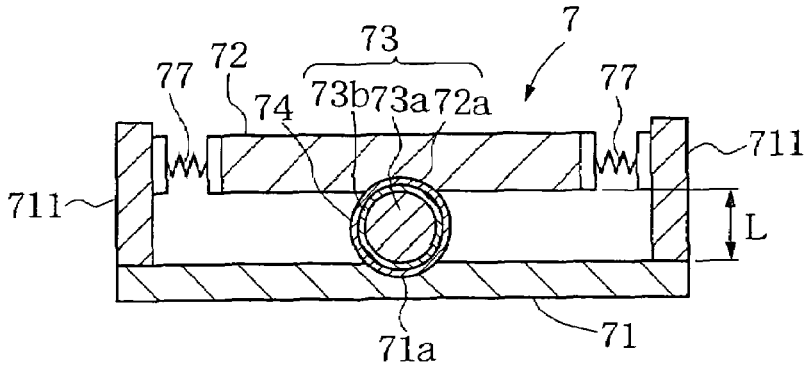
FIG. 7 is a sectional view taken along line VII-VII in FIG. 5.

Embodiments of the present invention will be described with reference to the accompanying drawings. FIG. 1 is a side view of an embodiment of a precision machining apparatus of the present invention. FIG. 2 is a perspective view of a movement adjustment means. FIG. 3 is a sectional view taken along line III-III in FIG. 2. FIG. 4 is a sectional view taken along line IV-IV in FIG. 2. FIG. 5 is a plan view of an embodiment of an attitude control device. FIG. 6 is a sectional view taken along line VI-VI in FIG. 5. FIG. 7 is a sectional view taken along line VII-VII in FIG. 5. In the illustrated embodiments, a pneumatic actuator is used. However, a hydraulic actuator may alternatively be used. Also, an arrangement using three of more actuators according to pressure control may be provided.

FIG. 1 shows an embodiment of the precision machining apparatus 1. The precision machining apparatus 1 is constituted mainly by a rotary device 6*a* for rotating an object a to be ground while the object a is being maintained in an attitude by being vacuum-attracted, a first pedestal 2 which supports the rotary device 6*a*, a second pedestal 3 which supports a rotary device 6*b* for rotating a grinding wheel b, a movement adjustment means for moving the second pedestal 3 in a horizontal direction, and a base 9 which supports the first and second pedestals 2 and 3 from below. Preferably, a diamond grinding wheel is used as the grinding wheel b at a rough grinding stage, and a CMG grinding wheel is used as the grinding wheel b at a super-precision grinding stage.

An attitude control device 7 is interposed between the first pedestal 2 and the rotary device 6*a*. The movement adjustment means is constituted by a feed screw mechanism 4 for controlling the second pedestal 3 on the basis of the amount of movement, and pneumatic actuators 5 for pressure-controlling the second pedestal 3. The feed screw mechanism 4 and the pneumatic actuator 5 are connected to a controller 8 and can be switched as required with respect to grinding stages. The positions of the object a to be ground and the grinding wheel b are detected at all times with position detection sensors (not shown). Piezoelectric elements and super-magnetostrictive elements which constitute the attitude control device 7 described below are expanded according to information on the detected positions to suitably correct the misalignment between the axes of the rotary devices 6*a* and 6*b*.

In the feed screw mechanism 4, a nut 42 is rotatably screw-threaded on a feed screw 41 attached to an output shaft of a servo motor 43. The nut 42 is attached to the second pedestal 3. Further, the second pedestal 3 is detachable from the nut 42.

FIG. 2 shows details of the movement adjustment means. The second pedestal 3 is formed so as to be L shaped in a side view. One side of the L shape corresponds to a side surface on which the rotary device 6*a* is mounted, and the other side of the L shape corresponds to a side surface joined to a plate member 44 by means of pin member 45. To the plate member 44, the nut 42 is directly attached.

A through hole in which the feed screw 41 is loosely fitted is formed in a portion 32 of the second pedestal 3 corresponding to the other side of the L shape. Pneumatic actuators 5*a* and 5*b* are fixed on the second pedestal 3 on left and right sides of the feed screw 41 loosely fitted. The pneumatic actuators 5*a* and 5*b* differ in pressure performance from each other. For example, the pneumatic actuator 5*a* assumes functioning in a comparatively low pressure region, while the pneumatic actuator 5*b* assumes functioning in a comparatively high pressure region. For example, in the pneumatic actuator 5*a*, a piston rod 5*a*2 is slidably inserted in a cylinder 5*a*1.

At a rough grinding stage as an initial stage in grinding, the plate member 44 connected to the nut 42 and the first pedestal 3 are connected by the pin members 45. Therefore the nut 42 is moved by a certain amount according to drive of the servo motor 43. The second pedestal 3 (the rotary device 6*b* mounted on the second pedestal 3) is moved by the corresponding amount with the movement of the nut 42.

At a super-precision grinding stage after rough grinding, the pin members 45 are removed to disconnect the plate member 44 and the second pedestal 3 from each other. In this state, the pneumatic actuator 5*b* assuming functioning in the high pressure region is driven. The second pedestal 3 is thereby pushed toward the first pedestal 2, with the plate member 44 pressed by one end of the piston rod 5*b*2 constituting the pneumatic actuator 5*b*, that is, the plate member 44 having a reaction force against the pneumatic actuator 5*b*. The plate member 44 is fixed to the nut 42 screw-threaded on the feed screw 41. Therefore the plate member 44 is capable of having a reaction force large enough to push out the second pedestal 3. In super-precision grinding, the pneumatic actuator 5*a* is selected as the next actuator to be used after staged constant-pressure grinding in the high pressure region to perform staged constant-pressure grinding in the same manner as in grinding in the low pressure region.

From FIG. 3 which is a sectional view taken along line III-III in FIG. 2, it can be understood that the second pedestal 3 can be pushed forward while one of the piston rods 5*a*2 and 5*b*2 of the pneumatic actuators 5*a* and 5*b* is receiving reaction force from the plate member 44.

From FIG. 4 which is a sectional view taken along line IV-IV in FIG. 2, it can be understood that the second pedestal 3 (the portion 32) and the plate member 44 to which the nut 42 is fixed are detachably joined to each other by the pin members 45, 45.

FIG. 5 shows an embodiment of the attitude control device 7, and FIG. 6 shows a sectional view taken along line VI-VI in FIG. 5. The attitude control device 7 has a frame open at its top and constituted by a first flat-plate member 71 and side walls 711. This frame can be made of an SUS material for example. A second flat-plate member 72 is set between pairs of side walls 711, 711 facing each other, with the second actuators 75, 75 interposed between the second flat-plate member 72 and the side wall 711. A suitable spacing L is provided between the first flat-plate member 71 and the second flat-plate member 72. The spacing L is large enough to prevent the first flat-plate member 71 and the second flat-plate member 72 from interfering with each other even when the second flat-plate member 72 is inclined. In the illustrated embodiment, a plurality of springs 77, 77, . . . are interposed between the side wall 711 and the second flat-plate member 72 as well as the second actuator 75 in order to retain the second flat-plate member 72 in the X-Y plane.

Each second actuator 75 is constituted by an axial member 75*c* having suitable rigidity, a super-magnetostrictive element 75*a* and a piezoelectric element 75*b*. The super-magnetostrictive element 75*a* is constructed by fitting a coil (not shown) around an element and is expandable by a magnetic field produced by causing a current to flow through the coil. The piezoelectric element 75*b* is also expandable by application of a voltage thereto. Further, a suitable current or voltage can be applied to the super-magnetostrictive element

75*a* or the piezoelectric element 75*b* according to information on the position of a mounted object (e.g., the rotary device, etc.) detected with a detection sensor (not shown). The super-magnetostrictive element 75*a* and the piezoelectric element 75*b* may be selectively operated with respect to working stages according to whether or not there is a need to move the second flat-plate member 72 comparatively largely. The super-magnetostrictive element 75*a* may be formed of an alloy of a rare-earth metal such as dysprosium or terbium and iron or nickel, as is that in the conventional art. The piezoelectric element 75*b* may be formed of lead zirconate titanate ($Pb(Zr,Ti)O_3$), barium titanate ($BaTiO_3$), lead titanate ($PbTiO_3$) or the like.

In a case where the attitude control device 7 is mounted, for example, on the first pedestal 2, the second actuators 75, 75 are operated when the second flat-plate member 72 is to be displaced along the X-Y plane (horizontal direction), and first actuators 76, 76 are operated when the second flat-plate member 72 is to be displaced in the Z-direction (vertical direction). Each first actuator 76 is constituted by an axial member 76*c* having suitable rigidity, a super-magnetostrictive element 76*a* and a piezoelectric element 76*b*, as is the second actuator 75.

A spherical member 73 is interposed between the first flat-plate member 71 and the second flat-plate member 72 as well as the first actuators 76, 76. FIG. 7 shows the spherical member 73 in detail.

The spherical member 73 is constituted by a spherical core 73*a* made of a metal for example, and a film 73*b* provided on the periphery of the core 73*a* and formed of graphite for example. Further, a film formed of an adhesive 74 capable of elastic deformation at ordinary temperature is formed on the outer peripheral surface of the film 73*b*. As the adhesive 74, an adhesive having a tensile shear strength of 10 to 15 Mpa, an attenuation coefficient of 2 to 7 Mpa·sec, preferably 4.5 Mpa·sec and a spring constant of 80 to 130 GN/m, preferably 100 GN/m (elastic epoxy-based adhesive) may be used. The thickness of the adhesive film may be set to about 0.2 mm.

Recesses 71*a* and 72*a* are formed as portions of the first flat-plate member 71 and the second flat-plate member 72 to be brought into contact with the spherical member 73. Portions of the spherical member 73 are fitted in the recesses 71*a* and 72*a* to position the spherical member 73. The adhesive 74 formed as a film on the outer peripheral surface of the spherical member 73 adheres to the surfaces in the recesses 21*a* and 22*a* but is separated from the spherical member 73 (the film 73*b* constituting the spherical member 73), so that the spherical member 73 can be freely rotated in the film of the adhesive 74.

When the attitude of the rotary device 6*a* is controlled by operating the first actuators 76 and the second actuators 75 in a state where the rotary device 6*a* is mounted on the second flat-plate member 72, the film formed of the adhesive 74 is elastically deformed to permit three-dimensional free displacement of the second flat-plate member 72. At this time, the core 73*a* constituting the spherical member 73 supports the weight of the rotary device 6*a* but only rotates at the fixed position without restraining the film of the adhesive 74 on its outer peripheral surface. The spherical member 73 only supports the weight of the rotary device 6*a* in its essential functioning, and the spherical member 73 and the adhesive 74 do not adhere to each other. Therefore, the adhesive 74 can elastically deform freely according to the displacement of the second flat-plate member 72 without being restrained by the spherical member 73. Thus, the second flat-plate member 72 receives only an extremely small amount of restraint corresponding to a reaction force in elastic deformation of the adhesive 74.

The method of precision working on an object to be ground using the above-described precision machining apparatus 1 will be outlined.

In the method of grinding an object to be ground (precision machining method) in accordance with the present invention, a process from rough grinding to final super-precision grinding is consistently performed by using only the precision machining apparatus 1 through the entire process. Rough grinding is first performed on the object a to be ground by using a diamond grinding wheel as the grinding wheel b while moving the second pedestal 3 (rotary device 6*b*) by a predetermined amount by means of the feed screw mechanism 4, thereby forming an intermediate ground object (first step). At this rough grinding stage, the positions of the grinding wheel b and the object a to be ground are detected. When a misalignment between the axis of the grinding wheel b and the axis of the object a to be ground occurs, the positions are corrected by the attitude control device 7.

Thereafter, the grinding wheel b is changed from the diamond grinding wheel to a CMG grinding wheel. The pneumatic actuator 5*b* is then operated to push the CMG grinding wheel toward the object a to be ground while changing the constant pressure stepwise in the comparatively high pressure region. At a final stage in grinding, the pneumatic actuator 5*a* is selected and final grinding is performed on the object a to be ground while also changing the constant pressure stepwise in the low pressure region. Also at this super-precision grinding stage, the positions of the grinding wheel b and the object a to be ground are detected at all times. When a misalignment between the axis of the grinding wheel b and the axis of the object a to be ground occurs, the positions are corrected by the attitude control device 7. By the above-described CMG machining process, the tip which has the degree of flatness of 10 to 20 nm/inch was obtained.

The embodiments of the present invention have been described in detail with reference to the drawings. However, the concrete construction of the invention is not limited to the embodiments. Various changes in the design or the like may be made without departing from the gist of the present invention. The present invention encompasses such changes.

What is claimed is:

1. A precision machining apparatus comprising:

a first rotary device for rotating an object to be ground;

a first pedestal supporting the first rotary device;

a second rotary device for rotating a grinding wheel;

a second pedestal supporting the second rotary device for rotating the grinding wheel;

movement adjustment means provided at the first pedestal and/or the second pedestal, the movement adjustment means being capable of moving one of the pedestals toward the other, wherein the movement adjustment means includes a first movement adjusting portion which moves the first or second pedestal and a second movement adjusting portion which applies a pressure to the first or second pedestal to cause the first or second pedestal to move in the direction of the movement, and wherein the amount of movement of the first or second pedestal and the first or second rotary device can be controlled by selectively using the first movement adjusting portion and the second movement adjusting portion; and an attitude control device interposed between the first rotary device and the first pedestal or between the second rotary device and the second pedestal, wherein the attitude control device controls the attitude of the first or second rotary device.

2. The precision machining apparatus according to claim 1, wherein the first movement adjusting portion includes a feed screw mechanism in which a nut screw-threaded on a feed screw is moved by the rotation of the feed screw, and the second movement adjusting portion includes a pneumatic actuator or a hydraulic actuator.

3. The precision machining apparatus according to claim 2, wherein the grinding wheel comprises at least a CMG grinding wheel.

4. The precision machining apparatus according to claim 2, wherein the second movement adjusting portion includes a plurality of pneumatic actuators or hydraulic actuators for controlling the movement of the first or second pedestal and the first or second rotary device.

5. The precision machining apparatus according to claim 1, wherein the second movement adjusting portion includes a plurality of pneumatic actuators or hydraulic actuators for controlling the movement of the first or second pedestal and the first or second rotary device.

6. The precision machining apparatus according to claim 5, wherein the grinding wheel comprises at least a CMG grinding wheel.

7. The precision machining apparatus according to claim 1, wherein the grinding wheel comprises at least a CMG grinding wheel.

8. A precision machining apparatus comprising:

a first rotary device for rotating an object to be ground;

a first pedestal supporting the first rotary device;

a second rotary device for rotating a grinding wheel;

a second pedestal supporting the second rotary device for rotating the grinding wheel;

movement adjustment means provided at the first pedestal and/or the second pedestal, the movement adjustment means being capable of moving one of the pedestals toward the other;

wherein the movement adjustment means includes a first movement adjusting portion which moves the first or second pedestal and a second movement adjusting portion which applies a pressure to the first or second pedestal to cause the first or second pedestal to move in the direction of the movement, and wherein the amount of movement of the first or second pedestal and the first or second rotary device can be controlled by selectively using the first movement adjusting portion and the second movement adjusting portion; and an attitude control device interposed between the first rotary device and the first pedestal or between the second rotary device and the second pedestal, the attitude control device controlling the attitude of the first or second rotary device, wherein the attitude control device includes a first flat-plate member extending in a plane defined by an X-axis and a Y-axis and a second flat-plate member disposed in parallel with the first flat-plate member while being spaced apart from the same; recesses are formed in surfaces of the two flat-plate members facing each other; a spherical member is interposed between the first flat-plate member and the second flat-plate member by fitting portions of the spherical member in the recesses; a first actuator expandable in a Z-axis direction perpendicular to the plane defined by the X-axis and the Y-axis is interposed between the first flat-plate member and the second flat-plate member; a second actuator expandable in a suitable direction in the plane defined by the X-axis and the Y-axis is connected to the second flat-plate member; the second flat-plate member is movable relative to the first flat-plate member while being in an attitude with an object mounted thereon; the spherical member is bonded to the first flat-plate member and/or the second flat-plate member by an adhesive elastically deformable; and a piezoelectric element and a super-magnetostrictive element are provided in each of the first actuator and the second actuator.

9. The precision machining apparatus according to claim 8, wherein the grinding wheel comprises at least a CMG grinding wheel.

* * * * *

UNITED STATES PATENT AND TRADEMARK OFFICE

CERTIFICATE OF CORRECTION

PATENT NO. : 7,247,081 B2
APPLICATION NO. : 11/316886
DATED : July 24, 2007
INVENTOR(S) : Sumio Kamiya et al.

It is certified that error appears in the above-identified patent and that said Letters Patent is hereby corrected as shown below:

On the Title Page, Item (73), in the Assignee, line 1, "Toyoda Jidosha Kabushiki Kaisha," should read -- Toyota Jidosha Kabushiki Kaisha, --

Signed and Sealed this

First Day of July, 2008

JON W. DUDAS
*Director of the United States Patent and Trademark Office*